US005769105A

United States Patent [19]

Margol et al.

[11] Patent Number: 5,769,105

[45] Date of Patent: Jun. 23, 1998

[54] STATIONARY BOAT COVER

[76] Inventors: Geoffrey Margol; Rodney S. Margol, both of 11062 Riverport Dr., West, Jacksonville, Fla. 32223

[21] Appl. No.: 944,373

[22] Filed: Oct. 6, 1997

[51] Int. Cl.[6] ..... E04H 15/04

[52] U.S. Cl. ..... 135/90; 135/96; 135/119

[58] Field of Search ..... 135/90, 88.13, 135/88.15, 96, 119, 115, 120.3, 120.4

[56] References Cited

U.S. PATENT DOCUMENTS

| | | | |
|---|---|---|---|
| 1,759,628 | 5/1930 | Pellegrino . | |
| 2,186,535 | 1/1940 | MacGeorge . | |
| 2,757,678 | 8/1956 | Stahl . | |
| 2,849,010 | 2/1958 | Marino . | |
| 2,926,678 | 3/1960 | Francis . | |
| 3,083,540 | 4/1963 | Smith . | |
| 4,019,212 | 4/1977 | Downer . | |
| 4,706,599 | 11/1987 | Johnson . | |
| 4,785,839 | 11/1988 | Hansen et al. | 135/90 |
| 4,825,578 | 5/1989 | Robinson | 135/90 X |
| 4,830,427 | 5/1989 | Fiocchi | 135/90 X |
| 5,086,799 | 2/1992 | Lumbleau . | |
| 5,573,026 | 11/1996 | Griffith . | |
| 5,621,926 | 4/1997 | La Madeleine | 135/90 X |

*Primary Examiner*—Lanna Mai
*Attorney, Agent, or Firm*—Lott & Friedland, PA

[57] ABSTRACT

A stationary boat cover suspended from an overhead supporting structure disposed over a boat lift for covering a boat. The stationary boat cover comprises a sheet, having a front, back and sides, a plurality of loops or grommets spaced from and along the sides of the sheet, a plurality of periphery cords having first ends, attached to the overhead supporting structure, and second ends, attached to the loops or grommets of the sheet, a circular wooden disk centrally located, below the sheet, with respect to the bow and stern of the boat, a central cord, shorter in length than the plurality of periphery cords, having a first end, attached to the overhead supporting structure, and a second end, passing through the sheet and attaching to the circular wooden disk, and a plurality of connecters having first ends attached to a catwalk surrounding the boat lift and a second ends attached to loops or grommets of the sheet. The sheet remains stationary and maintains its position above the boat lift as the boat raises into and lowers out of the sheet, by means of a boat lift. The plurality of connecters are used to secure the bottom of the sheet down over the top of the boat when the boat is raised.

3 Claims, 4 Drawing Sheets

STATIONARY BOAT COVER

TECHNICAL FIELD

This invention relates generally to a stationary boat cover and this invention specifically relates to a stationary boat cover suspended from an overhead supporting structure employed over a boat lift.

BACKGROUND OF THE INVENTION

The covering of boats is tedious and usually requires more than one person, but is essential for the protection and durability of the boat's interior and instrumentation from weather and theft. Traditional boat covers are difficult to install and require packing and storing when not in use. With the escalating cost of boat storage, alternative methods have been created to facilitate the installation and removal of boat covers.

Previous attempts have been made to provide covering methods for boats such as are described in U.S. Pat. No. 5,086,799 to Lambleau (the '799 patent); U.S. Pat. No. 5,573,026 to Griffith (the '026 patent); U.S. Pat. No. 4,019,212 to Downer (the '212 patent); U.S. Pat. No. 2,757,678 to Stahl (the '678 patent); and U.S. Pat. No. 1,759,628 to Pellegrino (the '628 patent), all of which are incorporated herein by reference.

The '799 patent describes a boat lift canopy that includes a cover suspended from an overhead structure and an apparatus for raising and lowering the cover. The canopy frame comprises three horizontal tubes and five horizontal "A" frames, each of the connections forming the frame being joined by use of a frame joint. The cover is supported by six pulleys that are attached to the overhead structure. Seven cables run through the pulleys and connect the cover to a winch. The winch is used to lift the cover when it is not in use, and to lower the cover when needed.

The '026 patent describes a vehicle cover for sheltering a boat that includes a canopy consisting of an overhead frame and a top cover. The top cover is attached to the frame by cords. The entire canopy is placed above the boat lift and remains stationary.

The '212 patent describes a boat cover apparatus that includes a lift assembly mounted on a frame for lifting a boat above the surface of the water and a cover apparatus. The cover apparatus includes a collapsible cover, attached to a frame. The frame is substantially larger than the upper peripheral dimensions of the boat so that when the frame is lowered, the collapsible cover abuts against the upper, outer peripheral edges of the boat. Cables run through pulleys and connect the frame to a winch. The winch is used to simultaneously lift the cover and lower the boat, or to lower the cover and raise the boat.

The '678 patent describes an automobile cover that includes a supporting structure and a collapsible hood-like cover. The hood-like portion of the cover is permanently attached to the supporting structure in a fixed manner. The collapsible portion of the cover is attached to the hood portion so that it may be raised or lowered. The cover is raised to its collapsible position via hoisting cables that are threaded through the supporting structure.

The '628 patent describes a suspended cover supported by an overhead structure. The cover is supported by pulleys that are attached to the overhead structure. Cables run through the pulleys and connect the cover to a winch. The winch is used to lift the cover when it is not in use, and to lower the cover when needed.

None of the devices described above describe a means by which to cover a boat by moving the boat either upwardly into the cover or downwardly out of the cover, while the cover remains stationary.

Thus, there is a need in the art for a stationary boat cover which requires minimal assembly and expense. There is additional need in the art for such a device to enable its user, working alone, to quickly and securely cover the boat.

SUMMARY OF THE INVENTION

The present invention solves significant problems in the art of boat covers by providing a stationary boat cover to be employed above a boat lift and attached to any supporting structure above a boat lift. Generally described, the present invention provides a stationary boat cover which includes a sheet secured by cords attached along its periphery to an overhead supporting structure, by a central cord attached in its center to the overhead supporting structure, and by connecters along its periphery attached to the catwalk surrounding the boat lift.

In a preferred embodiment of the present invention, a stationary boat cover is suspended from an overhead supporting structure located over a boat lift for covering a boat. The stationary boat cover comprises a sheet, having a front, back and sides, a plurality of loops or grommets spaced from and along the sides of the sheet, a plurality of periphery cords having first ends, attached to the overhead supporting structure, and second ends, attached to the loops or grommets of the sheet, a circular wooden disk centrally located, below the sheet, with respect to the bow and stern of the boat, a central cord, shorter in length than the plurality of periphery cords, having a first end, attached to the overhead supporting structure, and a second end, passing through the sheet and attaching to the circular wooden disk, and a plurality of connecters having first ends attached to a catwalk surrounding the boat lift and a second end attached to loops or grommets of the sheet. The sheet remains stationary and maintains its position above the boat lift as the boat raises into and lowers out of the sheet, by means of a boat lift. The plurality of connecters are used to secure the bottom of the sheet down over the top of the boat when the boat is raised.

Accordingly, it is an object of the present invention to provide a boat cover that remains stationary while the boat raises into and out of the cover, while maintaining its position when the boat is lowered out of the cover.

It is an additional object of the present invention to provide a stationary boat cover that enables the user to cover a boat without the need for excess maintenance, installation and expense.

It is an additional object of the present invention to provide a boat cover that makes it easy for one person, working alone, to secure and protect the boat.

These and other objects, features, and advantages of the present invention may be better understood and appreciated from the following detailed description of the embodiments thereof, selected for purposes of illustration and shown in the accompanying drawings.

DETAILED DESCRIPTION OF THE PREFERRED EMBODIMENT

Figure 1:
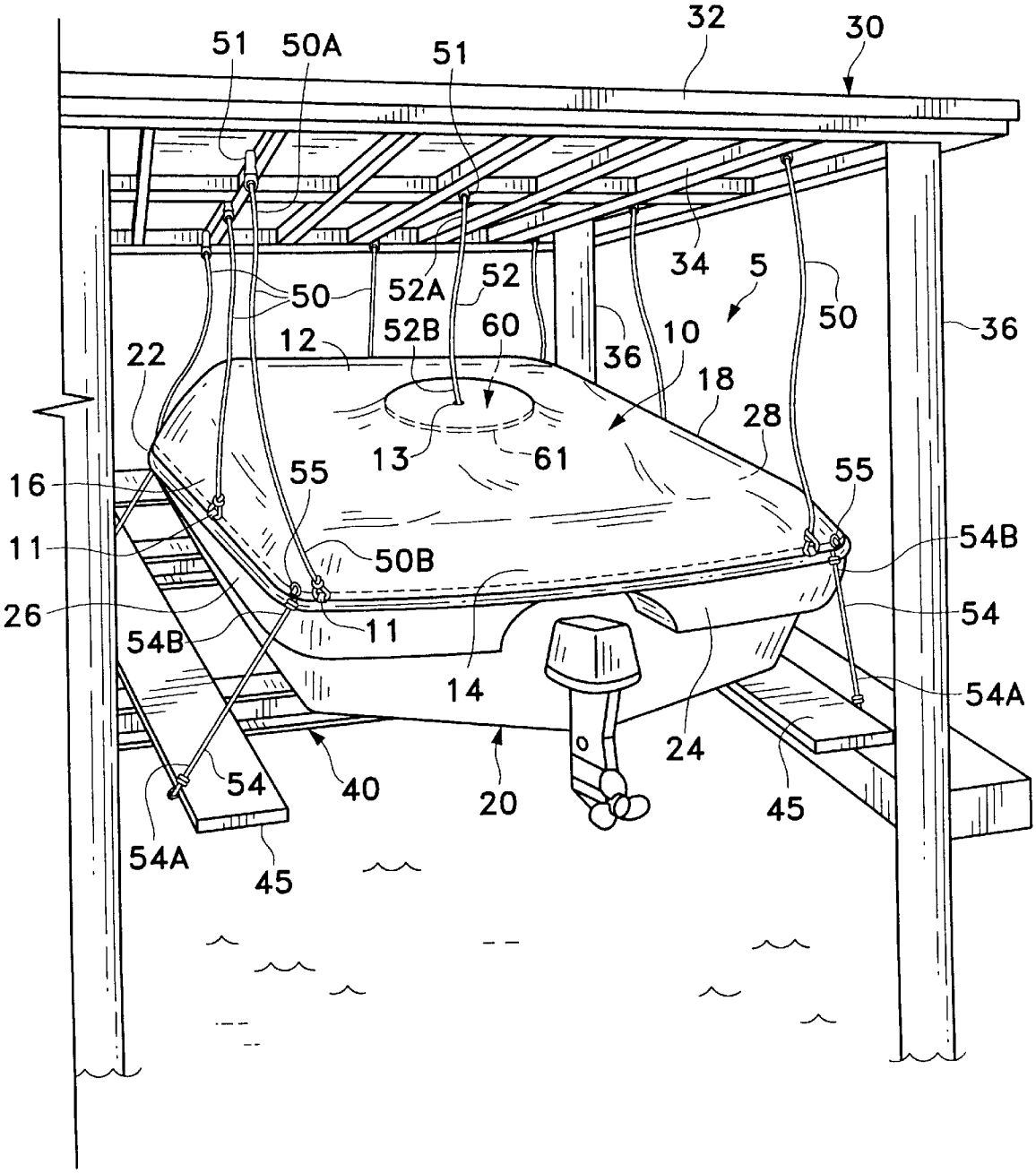
FIG. 1 is a perspective view of a boat in the raised position utilizing the present invention.
Figure 2:
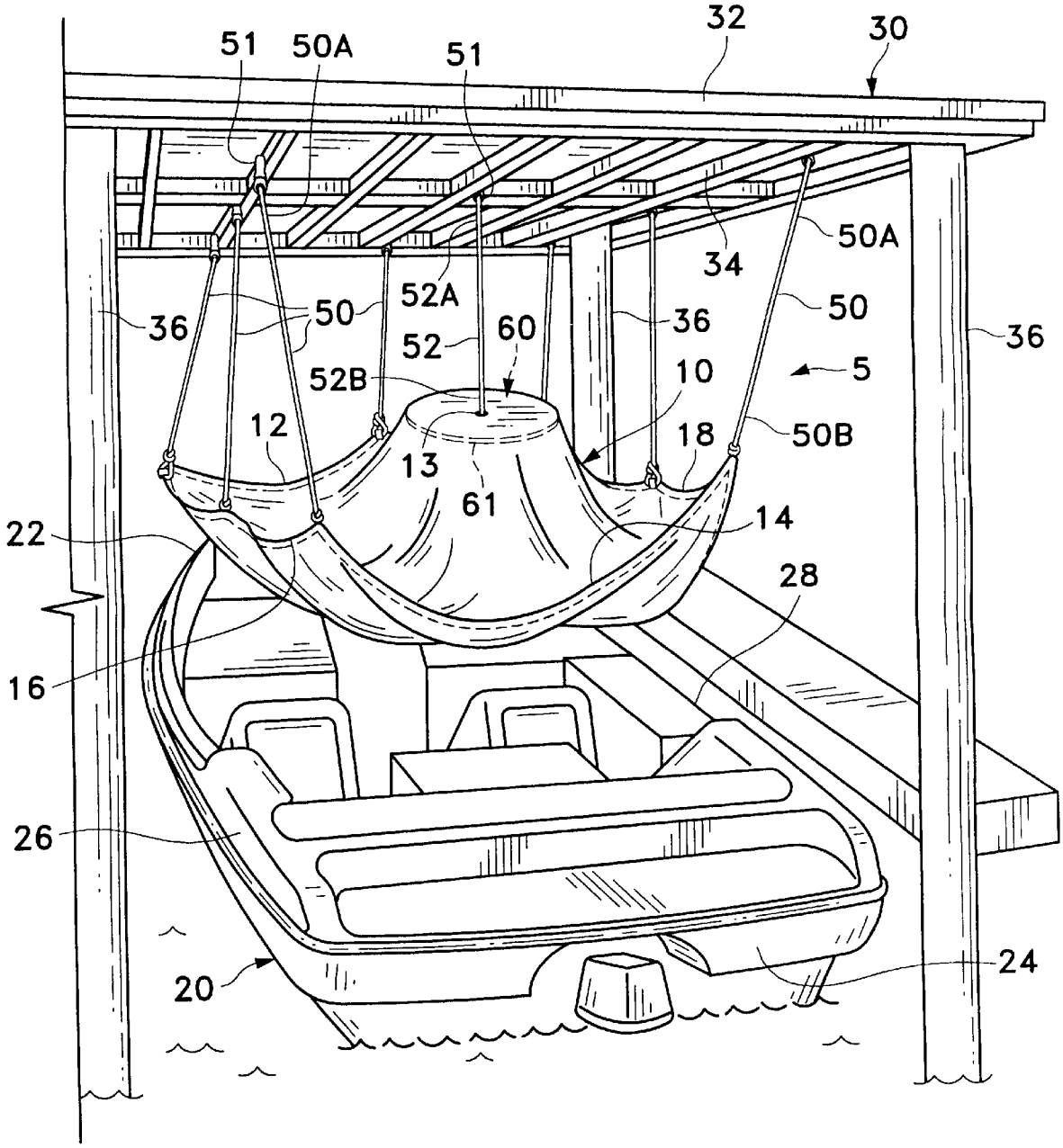
FIG. 2 is a perspective view of a boat in the lowered position illustrating the present invention suspended from the supporting structure.
Figure 3:
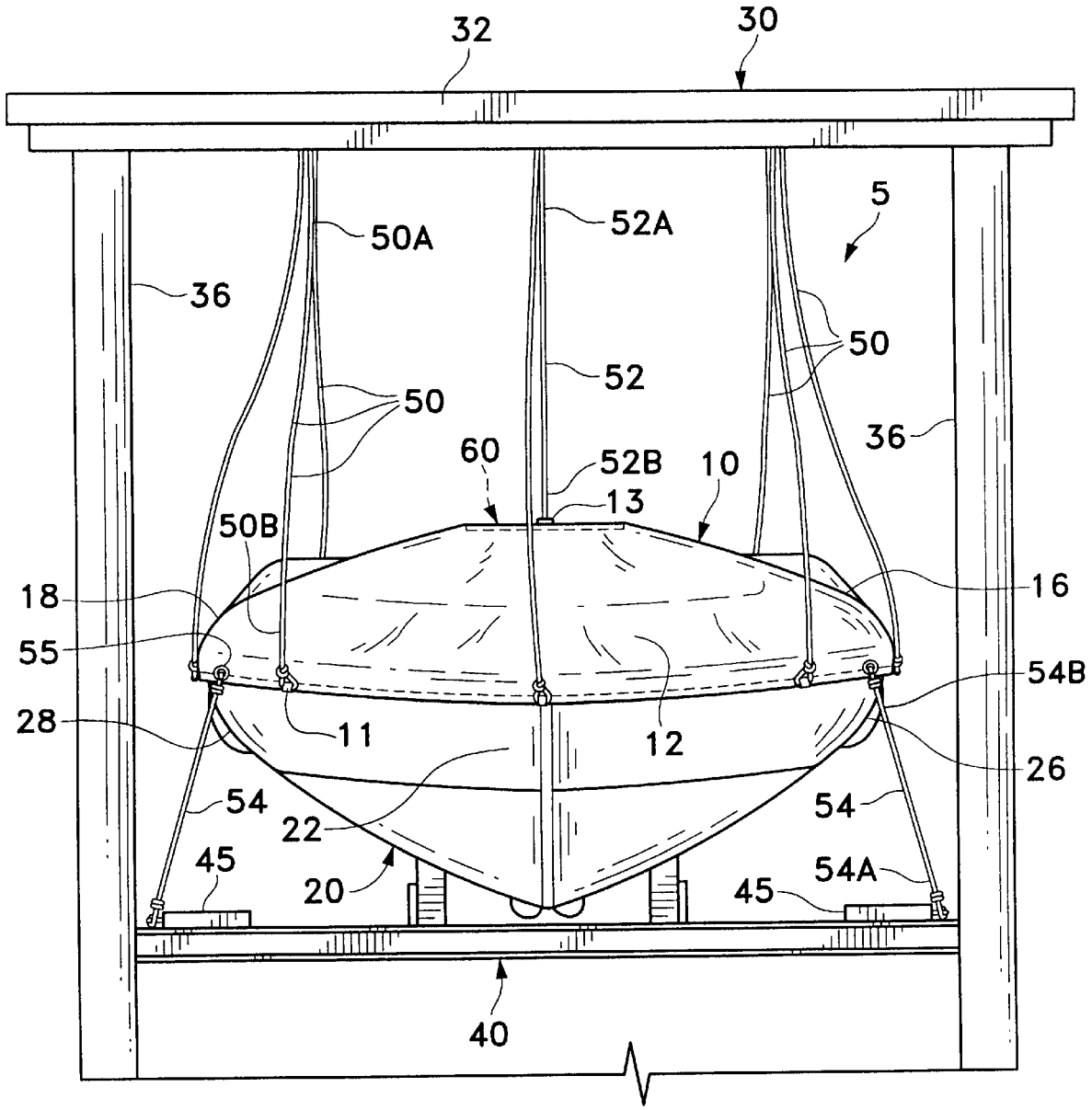
FIG. 3 is a front elevated view of the covered boat in FIG. 1.
Figure 4:
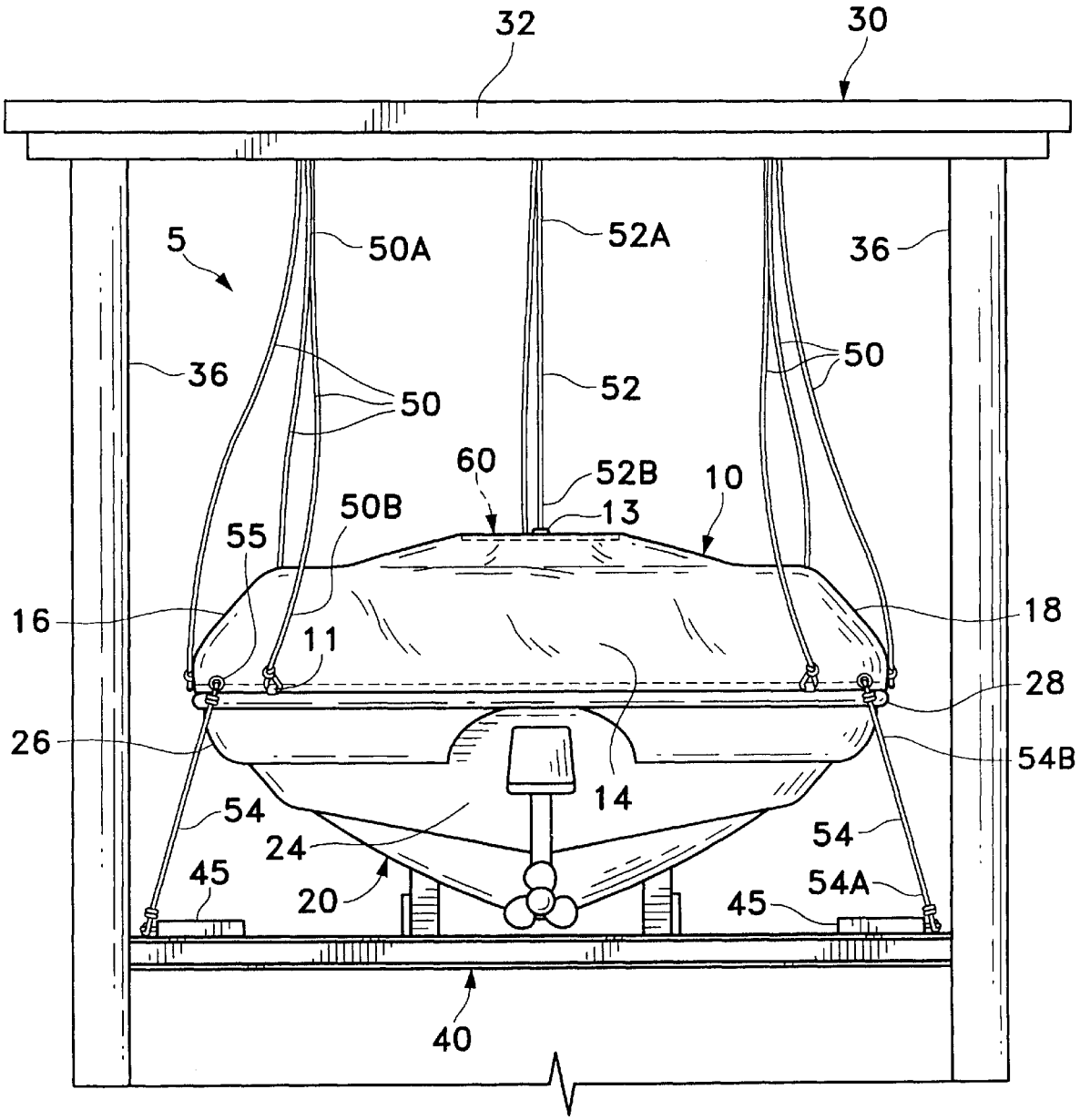
FIG. 4 is a back elevational view of the covered boat in FIG. 1.

Referring initially to FIG. 1 of the drawings, in which like numerals indicate like elements throughout the several views, in a preferred embodiment the boat cover of this invention is generally illustrated by reference numeral 5. Cover 5 is designed to be employed above a boat lift 40, and secured to an overhead supporting structure 30, or secured to any structure above the boat 20, such as a boathouse. Overhead supporting structure 30 includes a roof 32 with roof beams 34 supported by columns 36. In the water below the overhead supporting structure 30 is a boat lift 40, surrounded by a catwalk 45.

Cover 5 includes a sheet 10 having a front portion 12, a back portion 14 and side portions 16 and 18. Front portion 12 is positioned over the bow 22 of boat 20. Back portion 14 is positioned over the stem 24 of boat 20. Side portions 16 and 18 are positioned over the sides 26 and 28, respectively, of boat 20. Sheet 10 further comprises a plurality of loops or grommets 11 along sides 16 and 18 of the sheet 10 and a grommet 13, centrally positioned with respect to the bow 22 and stem 24 of boat 20.

The sheet 10 is suspended by a plurality of periphery cords 50, or the like, spaced around the periphery of the sheet 10 and by central cord 52, centrally positioned with respect to the bow 22 and stem 24 of boat 20. Cords 50 and 52 maintain the sheet 10 in position to be quickly attached to the boat 20 when it is raised by the boat lift 40.

Each periphery cord 50 includes a first end 50A and a second end 50B. The first end 50A of periphery cord 50 is secured to the roof beam 34 of overhead supporting structure 30 by means of eye hook 51, having a rotating feature to prevent tangling. The second end 50B of periphery cord 50 is attached to the loop or grommet 11 of sheet 10, spaced at a plurality of locations around the periphery of the sheet 10.

Central cord 52 includes a first end 52A and a second end 52B. The first end 52A is secured to the roof beam 34 of overhead supporting structure 30 by means of eye hook 51. The second end 52B of central cord 52 is attached to a central supporting member 60, located below the sheet 10. The central supporting member 60 includes a circular wooden disk 61 and provides additional support to the sheet 10 when it is suspended by itself. The second end 52B of central cord 52 passes freely through grommet 13, centrally located with respect to the bow 22 and stern 24 of boat 20, and attaches to the circular wooden disk 61. Central cord 52, attached to circular wooden disk 60, is shorter than periphery cords 50, causing the central portion of the sheet 10 between the bow 22 and stern 24 of boat 20 to be higher than its sides 16 and 18. The central cord 52 maintains the center of the sheet 10 high enough to allow water to drain off the sides. This height prevents the accumulation of water on top of the sheet 10 from weighing down the middle of the sheet 10.

The periphery of sheet 10 is secured down, over the top of boat 20, by a plurality of connecters 54. Connecters 54 include a first end 54A and a second end 54B. The first end 54A is secured to the catwalk 45, surrounding the boat lift 40, while the second end 54B attaches to the periphery of sheet 10 at grommets 55, spaced around the periphery of sheet 10. The connecters 54 are attached to the sheet 20 when the boat 20 is raised by boat lift 40. The connecters 54 may be elastic to provide some tension to hold the sheet 10 down tightly over the boat 20.

When the boat 20 is lifted by the boat lift 40, sheet 10 is already in position to be secured. The boat 20, thus, moves into the sheet 10, while the sheet 10 remains stationary, or suspended by periphery cords 50 and 52. The plurality of periphery cords 50 around the periphery of sheet 10 keep the sheet relatively positioned over the bow 22, stern 24 and sides 26 and 28 of the boat 20. The user has only to put the edges over the bow 22, stern 24 and sides 26 and 28 of the boat 20 and attach the connecters 54 to keep the sheet 10 securely over the top of the boat 20. One person, working alone, can accomplish this task.

When lowering the boat 20, the connecters 54 are detached and the sheet 10 suspends alone by means of the periphery cords 50 and central cord 52 from the overhead supporting structure 30, with the central cord 52 attached to the circular wooden disk 60 to provide additional support. When the boat 20 is lowered, the sheet 10 maintains its position above the boat lift 40.

Having described the invention in detail, those skilled in the art will appreciate that modifications may be made of the invention without departing from its spirit. Therefore, it is not intended that the scope of the invention be limited to the specific embodiments illustrated and described. Rather it is intended that the scope of the invention be determined by the appended claims and their equivalents.

What is claimed is:

1. A cover suspended from an overhead supporting structure disposed over a boat lift, surrounded by a catwalk, for covering a boat, comprising:

a sheet having a front, a back and sides;

a plurality of periphery cords having first and second ends, said first end connected to said overhead supporting structure and said second end connected to said sheet;

a central supporting member located below said sheet;

a central cord having a first and second end, said first end connected to said overhead supporting structure and said second end, passing through said sheet, connected to said central supporting member located under said sheet; and a plurality of connecters having first and second ends, said first end connected to said catwalk and said second end connected to said sheet to secure said sheet over the boat.

2. A cover as claimed in claim 1, wherein said central supporting member comprises a circular wooden disk.

3. A cover as claimed in claim 1, wherein said central cord is shorter in length than said plurality of periphery cords for elevating the center of said sheet.

* * * * *